US011608587B2

(12) United States Patent
Naor et al.

(10) Patent No.: US 11,608,587 B2
(45) Date of Patent: Mar. 21, 2023

(54) FOLDING MACHINE ARTICLE CLIP, ARTICLE CLIP ASSEMBLY AND FOLDING MACHINE ARTICLE FEEDING METHOD

(71) Applicant: MIELE & CIE. KG, Gütersloh (DE)

(72) Inventors: Isaac Naor, Hod Hasharon (IL); Alon Naim, Rosh Ha-Ayin (IL); Bilal Saudi, Taibe (IL)

(73) Assignee: MIELE & CIE. KG, Gutersloh (DE)

( * ) Notice: Subject to any disclaimer, the term of this patent is extended or adjusted under 35 U.S.C. 154(b) by 0 days.

(21) Appl. No.: 16/958,874

(22) PCT Filed: Dec. 30, 2018

(86) PCT No.: PCT/IL2018/051407
§ 371 (c)(1),
(2) Date: Jun. 29, 2020

(87) PCT Pub. No.: WO2019/130316
PCT Pub. Date: Jul. 4, 2019

(65) Prior Publication Data

US 2020/0340171 A1 Oct. 29, 2020

Related U.S. Application Data

(60) Provisional application No. 62/612,649, filed on Jan. 1, 2018.

(51) Int. Cl.
*D06F 89/00* (2006.01)
*B25B 5/04* (2006.01)
*B25B 5/16* (2006.01)

(52) U.S. Cl.
CPC ..... *D06F 89/005* (2013.01); *B25B 5/04* (2013.01); *B25B 5/16* (2013.01)

(58) Field of Classification Search
CPC .... B25B 5/04; B25B 5/12; B25B 5/16; D06F 67/04; D06F 89/00
See application file for complete search history.

(56) References Cited

U.S. PATENT DOCUMENTS 3,071,406 A * 1/1963 Lucker, Jr. ..... B66C 1/48 294/104
3,204,748 A * 9/1965 Soules ..... A01D 46/02 198/470.1

(Continued)

FOREIGN PATENT DOCUMENTS

CN 2831967 Y * 11/2006
DE 19703587 A1 8/1998
WO 2018122841 A1 7/2018

OTHER PUBLICATIONS

Wu, Lei-meng. "Machine Translation of CN 2,831,967". Nov. 1, 2006 (Year: 2006).*
Int'l. Search Report for PCT/IL2018/051407, dated Apr. 17, 2019.

*Primary Examiner* — Lee D Wilson
*Assistant Examiner* — Aaron R McConnell
(74) *Attorney, Agent, or Firm* — The Roy Gross Law Firm, LLC; Roy Gross

(57) ABSTRACT

An article clip for article folding machines includes a body which includes opposite body front and rear ends and a body intermediate portion which extends therebetween. The body front end includes a front body pivot and the body intermediate portion includes an intermediate body pivot. The clip further includes a base jaw located at the front end and a clamping jaw located opposite the base jaw at the body front end, connected to the body via the front body pivot. The clip further includes a clamping recess formed in the body front end. The clip further includes an elongated driver configured to transfer forces from the body rear end to the clamping jaw. The driver is connected to the clamping jaw via a front (Continued)

floating pivot which is not connected to the body, and is connected to the intermediate body pivot via a pulling mechanism.

5 Claims, 3 Drawing Sheets

(56) References Cited

U.S. PATENT DOCUMENTS

| | | | | | |
|---|---|---|---|---|---|
| 3,297,354 | A * | 1/1967 | Renfroe | B66C 1/48 | 294/104 |
| 3,414,315 | A * | 12/1968 | O'Quinn | B66C 1/48 | 294/104 |
| 3,441,308 | A * | 4/1969 | Gardner | B66C 1/48 | 294/101 |
| 3,910,380 | A * | 10/1975 | Nameche | E06C 1/34 | 182/206 |
| 2014/0266225 | A1* | 9/2014 | Coleman | G01R 1/22 | 324/426 |
| 2015/0321851 | A1* | 11/2015 | Sielermann | D06F 55/02 | 294/197 |

* cited by examiner

FOLDING MACHINE ARTICLE CLIP, ARTICLE CLIP ASSEMBLY AND FOLDING MACHINE ARTICLE FEEDING METHOD

FIELD OF THE INVENTION

The subject matter of the current application relates to compact garment/fabrics folding machines. Specifically, it relates to article clips for laundry articles folding machines which are configured to hold an article and pull it into the folding machine to be folded.

BACKGROUND OF THE INVENTION

U.S. Pat. No. 9,630,780 discloses an article clip of the field.

SUMMARY OF THE INVENTION

In accordance with a first aspect according to the subject matter of the present application there is provided an article clip for automatic article folding machines comprising:

a body comprising opposite body front and rear ends and a body intermediate portion extending therebetween, the body front end comprising a front body pivot and the body intermediate portion comprising an intermediate body pivot, a base jaw located at the front end;

a clamping jaw located opposite the base jaw at the body front end, connected to the body via the front body pivot; and a clamping recess formed in the body front end;

wherein the clip further comprises an elongated driver configured to transfer forces from the body rear end to the clamping jaw, the driver being connected to the clamping jaw via a front floating pivot which isn't connected to the body, and connected to the intermediate body pivot via a pulling mechanism.

In accordance with a second aspect according to the subject matter of the present application there is provided a method of handing over, or feeding an article to an article folding machine comprising at least two article clips according to claim 1, the method comprising the following steps:

a. holding the article at two article edges stretched in a width direction of the article;

b. inserting both article edges into the clamping recess between the clamping and base jaws of each clip;

c. releasing the article.

In accordance with a third aspect according to the subject matter of the present application there is provided a folding machine comprising the article clip.

In accordance with a fourth aspect according to the subject matter of the present application there is provided an article clip assembly for laundry article folding machines comprising:

a width axis, a depth axis extending along an elongation direction thereof, and a height axis of a 3D euclidean space;

a major clip; and a minor clip having a clip width shorter than a clip width of the major clip;

wherein the minor clip is rigidly secured to the major clip and spaced apart therefrom.

In accordance with a fifth aspect according to the subject matter of the present application there is provided a folding machine comprising the article clip assembly.

In accordance with a sixth aspect according to the subject matter of the present application there is provided an article clip assembly (80) for laundry article folding machines (10) comprising:

a width axis, a depth axis and a height axis of a 3D euclidean space;

a major clip; and a minor clip having a smaller dimension in the width axis direction than the major clip;

wherein the minor clip is rigidly and permanently connected to the major clip.

Any of the following features, either alone or in combination, may be applicable to any of the above aspects of the subject matter of the application:

The base jaw can be a static jaw, which is rigidly connected to the body.

The clamping jaw can be an active jaw, which is rotatable about the front body pivot with respect to the body.

The clamping jaw further comprises only a single rigid pressing lever protruding outwardly from the body front end.

The driver has a driver rear end which is connected to a rear lever, and the rear lever is connected to the body via a rear body pivot.

At an outward-most portion thereof, the rear lever preferably includes a friction-reduction member.

The friction-reduction member can be a wheel or a bearing.

The friction-reduction member can have a Teflon based coating.

One of the base and clamping jaws can include a conducting member configured to close a circuit built into the opposite jaw.

The pressing lever, in a pressed position, does not interfere with article motion into and out of the clamping recess.

The clamping jaw can have a high-friction grip surface configured for improving friction with the articles.

The pulling mechanism can be an extension spring.

The clip has an open, operative position in which the clamping jaw is not in contact with the base jaw; and a closed, non-operative position in which the clamping jaw abuts the base jaw.

The clip can be a major clip which has a clip length, a clip width, and a major length to width ratio which can range between 1 and 4.

The major clip has a clip height and a major length to height ratio which ranges between 1.3 and 6.

The clip is a minor clip which has a clip length, a clip width, and a minor length to width ratio which ranges between 3 and 20.

The minor clip has a clip height and a minor length to height ratio which ranges between 2 and 10.

The minor clip has a clip height which is larger than its clip width.

The major clip has a clip height which is smaller than its clip width.

The clip length is larger than the clip height and the clip width.

The minor and major clips can have different clamping recess heights along the height axis direction, each clamping recess height configured to accommodate different ranges of article sizes.

The clip assembly can include exactly one major clip and exactly two minor clips; and in a view along the depth axis the minor clips are located on opposite sides of the major clip in the width axis direction.

The minor clips are located at least partially forwardly of the major clip in a view along the width axis.

In a front view thereof, the major clip is located at least partially above the minor clip along the height axis.

BRIEF DESCRIPTION OF THE DRAWINGS

For a better understanding of the subject matter of the present application and to show how the same may be carried out in practice, reference will now be made to the accompanying drawings, in which.

Figure 1:
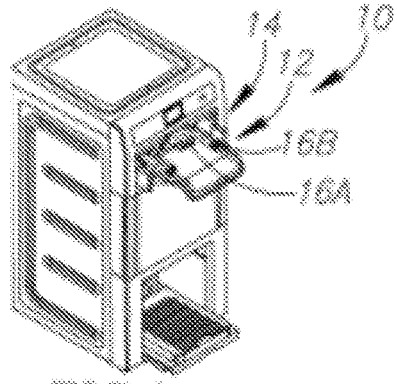
FIG. 1 is an isometric outer view of a compact article folding machine with a loading system and a hanger extended in a fully extended position, or an operative mode.
Figure 2:
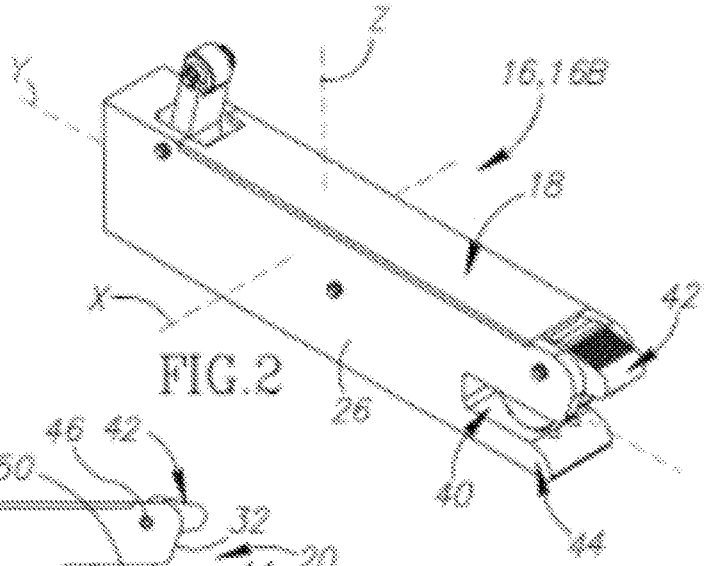
FIG. 2 is an isometric view of a first embodiment of an article clamp, or clip, in a closed position.
Figure 3:
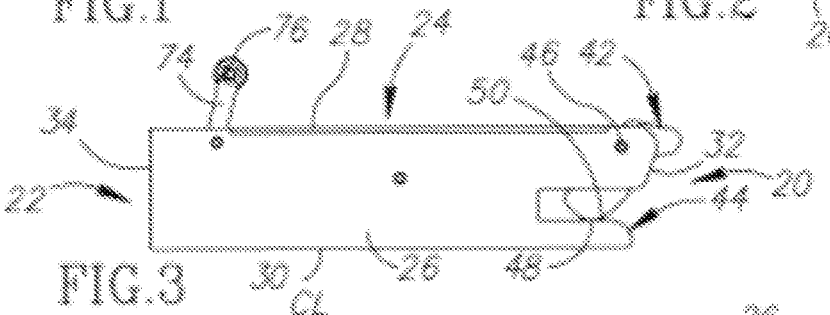
FIG. 3 is a side view of the clip of FIG. 2.

Where considered appropriate, reference numerals may be repeated among the figures to indicate corresponding or analogous elements.

DETAILED DESCRIPTION OF THE INVENTION

In the following description, various aspects of the subject matter of the present application will be described. For purposes of explanation, specific configurations and details are set forth in sufficient detail to provide a thorough understanding of the subject matter of the present application. However, it will also be apparent to one skilled in the art that the subject matter of the present application can be practiced without some specific configurations and details presented herein.

Reference is made to FIG. 1. A compact folding machine 10 has machine top and bottom ends and the top end includes an article feeding, or loading system 12 which can protrude outwardly therefrom. Articles are fed to the loading system 12, and then pulled into the folding machine 10.

The loading system 12 can include an active, automatic hanger 14 and a conveyor which is located inwardly within the folding machine 10, and under the hanger 14. The hanger 14 is configured to receive articles from a machine operator, or a user, and to hold and pull the article inwards, into the folding machine 10. The loading system 12 can further include a passive, width-folder onto which the articles are pulled to fold excessive fabric of the article.

The loading system 12 is preferably at least partially retractable, i.e., it can be drawn in, or fold, inside the folding machine 10 when not in use i.e., in the non-operative mode. In the operative mode, the loading system 12 protrudes outwardly from the folding machine 10 as seen in FIG. 1.

The active hanger 14 advantageously extends outwardly from the folding machine 10, since it becomes easier to "hand over" the articles to the hanger 14 in the loading system 12 when it extends outwardly from the folding machine 10, being more accessible to the operator, at least in the sense that the operator's hands don't come in contact with other portions of the folding machine 10. Furthermore, once the article is held by the hanger 14, this outwards extension is advantageous for folding, since it allows most of the fabric to hang, or be pulled downwards by gravity, thereby stretching and loosening any existing folds or twists in the fabric.

According to the present example, the active hanger 14 includes a hanger rail, which can extend outwardly. This actuation mechanism which moves the hanger 14 into, or out of, the folding machine 10 can be chosen according to the application as needed. Therefore, any suitable mechanism that can perform said movement of the hanger 14 can be selected. The hanger 14 can include one or more article clamps configured for releasably clipping the fabric. An article clamp, or holding, mechanism will be referred to herein as an article clip 16. The clips 16 can be made at least of plastic, or other, suitable material for the purposes disclosed herein.

As will be further disclosed below, each clip 16 has an open, or operative, position, in which an article can be held, and a closed, or non-operative position without an article. Each clip 16 is in a closed position by default, in which it ready to receive and clamp an article edge.

The clip 16 includes a body 18, or housing, which includes opposite body front and rear ends 20, 22 and a body intermediate portion 24 which extends therebetween. The body 18 has a width axis X, a depth axis Y and a height axis Z belonging to a 3D Euclidean space. The body is elongated and extends along the depth axis Y. The body 18 has opposite clip side surfaces 26 and clip top and bottom surfaces 28, 30 which extend therebetween. The clip 16 further includes opposite clip front and rear surfaces 32, 34 which extend, respectively, between the clip top and bottom surfaces 28, 30 and between the clip side surfaces 26. The clip side surfaces 26 extend generally parallel to a YZ plane defined by the depth and height axes Y, Z. The clip top and bottom surfaces 28, 30 extend generally parallel to an XY plane defined by the width and depth axes X, Y axes. The clip front and rear surfaces 32, 34 extend generally parallel to an XZ plane defined by the width and height axes X, Z.

The body front end 20 includes a clamping recess 40, a clamping jaw 42 located at least partially opposite a base jaw 44 and a front body pivot 46.

According to the present embodiments, the base jaw 44 can be a static base jaw 44, which means that the jaw is a rigid member which protrudes from the body front end 20 and is formed integrally therewith. In other words, in the present embodiments, the base jaw 44 is a part, or an extension, of the body front end 20.

According to the present embodiments, the front body pivot 46 is located internally within the body front end 20, between the clip side surfaces 26. The clamping jaw 42 is connected to the body 18 via the front body pivot 46, and located at least partially internally within the body front end 20, between the clip side surfaces 26. The pivots, as they are referred to in the present text can be hinges, pins or joints which can also serve as attachment means. In the present text, where appropriate, the word 'connected' is used to describe a rotational-relationship with the pivots. Put differently, the clamping jaw 42 is connected to, and therefore rotates about, the front body pivot 46 with respect to the body 18.

The clamping recess 40 can represent the vacant space between the jaws 42, 44, but it can also be an opening formed in the body front end 20. According to the present embodiments, the clamping recess 40 opens out to the clip side surfaces 26 and to the clip front surface 32. According to the present embodiment, the clamping jaw 42 extends into the clamping recess 40. The clamping recess can have a clamping recess height H measured parallel to the height axis Z.

According to the present embodiments, the clamping jaw 42 is configured to always press and hold the article against the base jaw 44 as will be further explained below. According to the present example, the clamping and base jaws 42, 44 have respective clamping and base surfaces 48, 50. The base surface 50 can be e.g., planar, or convex. Once the article edge has been inserted into the clamping recess 40 and released by the operator, the clip 16, by default, will hold the fabric and prevent the article edge from exiting the clamping recess 40.

According to the present embodiments, the clip 16 can include at least a sensor 52 which gives an indication whether the clamping jaw 42 is in engagement with the base jaw 44. The sensor 52 can be a contact-triggered sensor. The sensor 52 can be chosen according to various application-related (i.e., fabric type), and/or cost-related criteria. According to the present example, the sensor 52 is a mechanism configured to close an electric circuit. The clamping jaw 42 can include a conductive metal secured in the clamping surface 48, and the base jaw 44 has spaced apart wiring running through the base surface 50. In the closed position, the clamping jaw 42 engages the base jaw 44, thereby conductive material in the clamping surface 48 engages and the closes the circuit in the base surface 50. This is advantageous since the wiring only has to go through one of the jaws, which lowers production costs, compared, e.g. to wiring passing through both jaws. According to the present embodiments, the clamping surface 48 can be void of a protrusion.

During a transition from the closed to the open positions (e.g., during insertion of an article edge) the clamping jaw 42 moves away from the base jaw 44 by rotating about the front body pivot 46. During said transition, the clamping and base surfaces 48, 50 also move apart from each other, thereby allowing for an almost parallel orientation between the jaws, which facilitates insertion of the article edge. In other words, the clamping jaw 42 can move away from the clamping recess 40 into the body 18.

According to the current embodiments, the clamping jaw 42 is always, or normally, forced against the base jaw 44 via a pulling mechanism 54. The pulling mechanism 54 can be elastic, or, e.g., motorized. Therefore, once the operator/user releases the article edge after insertion, the clamping jaw 42 forces the fabric against the base jaw 44, preventing it from exiting the clamping recess 40. Consequently, once the hanger 14 is moved, the clips 16 pull the article.

The clamping jaw 42 can be elongated, and can have two opposite extremities—a clamping portion 56 which includes the clamping surface 48, and a pressing lever 58 located opposite thereto. The pressing lever 58 protrudes outwardly in the depth axis Y from the body front end 20 in the closed position, such that it is more accessible to a user, or an operator. The clamping jaw 42 is connected to the front body pivot 46 between the clamping portion 56 and the pressing lever 58. The clamping surface 48 of the clamping portion 56 preferably has a textured, or non-smooth, surface to increase friction forces with the article edge/fabric.

The clamping portion 56 engages the base jaw 44 in the closed position, and the pressing lever 58 is configured to enable manual transition from the closed to the open position. The user, or operator, presses the pressing lever 58 to raise the clamping jaw 42 and open a pathway for the article to enter the clamping recess 40.

Figure 6:
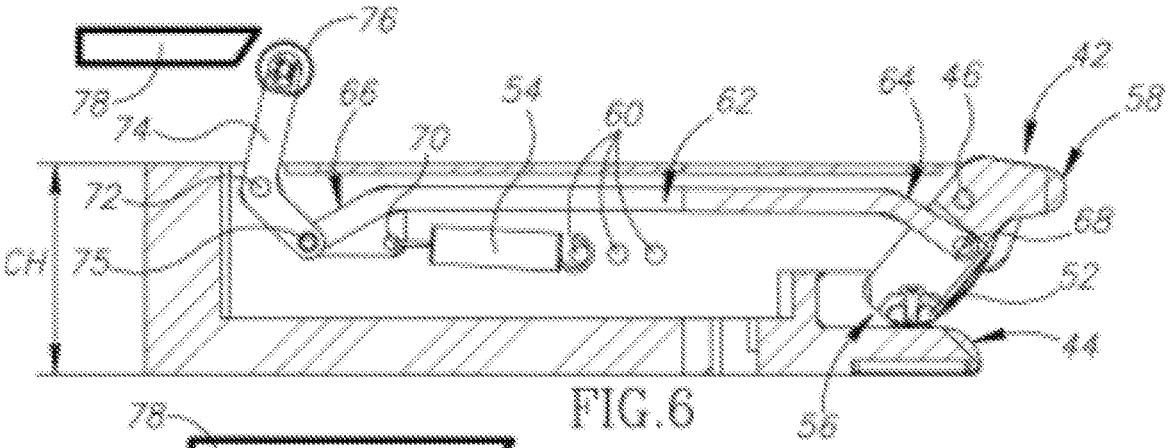
FIG. 6 is a cross-section of the clip of FIG. 4 taken along line VI-VI, before contacting a stopper.
Figure 7:
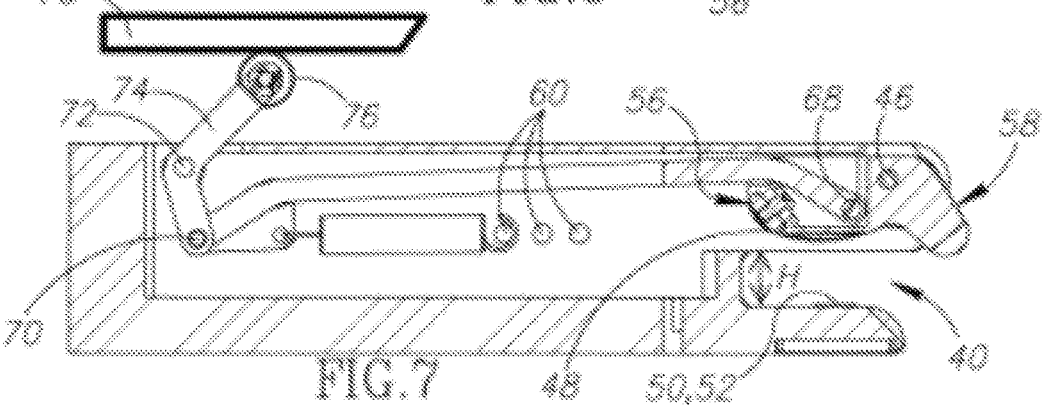
FIG. 7 is a cross-section of the clip of FIG. 5 taken along line VII-VII, after contacting the stopper, which transitioned the clip into the open position.
Figure 8:
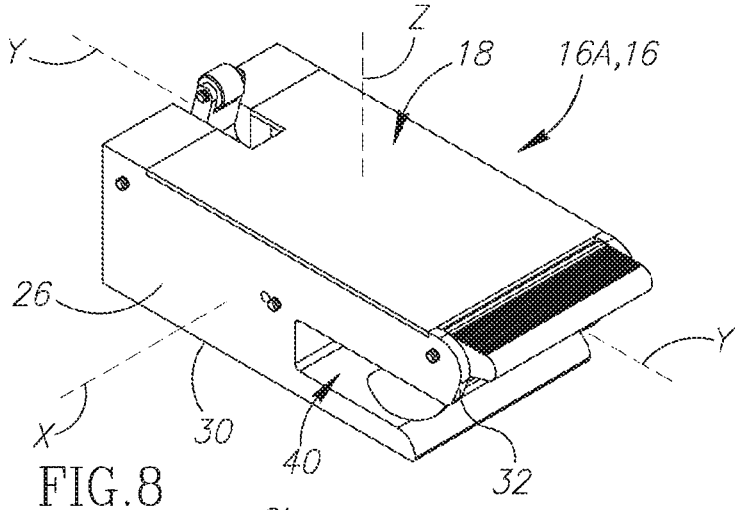
FIG. 8 is an isometric view of a wider, second embodiment of the article clip.

Attention is drawn to FIGS. 6, 7, 11 and 12. The body intermediate portion 24 includes an intermediate body pivot 60. The intermediate body pivot 60 can have several positions, or anchoring positions (as seen in FIGS. 6 and 7). This enables several degrees of spring rate/tension, which allows for customizing the clip 16 for handling different article thickness/fabric-types. In other words, the clip 16, and consequently the clamping jaw 42, can exert different ranges of clamping forces respective of each setting/anchoring point.

The body intermediate portion 24 includes an elongated driving member, or driver 62. The driver 62 is preferably located entirely internally within the body 18. Stated differently, in preferred embodiments, no portion of the driver 62 protrudes from the body 18. The driver 62 has opposite driver front and rear ends 64, 66. The driver front end 64 is connected to the clamping jaw 42 via a front floating pivot 68. The driver 62 further has an intermediate floating pivot 70 which is connected to the intermediate body pivot 60 via the pulling mechanism 54, which can be an extension spring 54.

The body rear end 22 can include a rear body pivot 72. The body rear end 22 can further include a rear lever 74 which is connected to the body rear end 22 via the rear body pivot 72 and serves as a releasing mechanism which enables the clip 16 to release the fabric clamped by the clamping jaws 42, 44. According to the present embodiment, the rear lever 74 is at least partially located within the body 18, while the rest protrudes from the clip top surface 28.

The rear lever 74 can have an elongated shape and protrudes outwardly from the body rear end 22. The rear lever 74 is also connected to the driver rear end 66 via a rear floating pivot 75. At an outward most portion of the rear lever 74, the rear lever 74 preferably includes a friction-reduction member 76 such as a wheel, a bearing, or a passive friction reduction material such as Teflon-coated protrusion.

At an inwards release portion within the folding machine 10, the folding machine 10 can include a release edge, a stopper 78, or an equivalent mechanism, against which the rear lever 74 is forced, when the clip 16 moves inwardly while pulling the article. This engagement with the stopper 78 causes the rear lever 74 to rotate about the rear body pivot 72. Since it is connected to the driver 62 via the rear floating pivot 75, the rotation of the rear lever 74 pushes the driver 62 (against the pulling forces of the extension spring 54), and in turn, the driver 62 moves, or lifts, the clamping jaw 42 which enables a release of the fabric/article edge. The driver 62 is therefore configured to drive, or transfer forces from the inward portion of the folding machine 10, to the clamping jaw 42.

Figure 4:
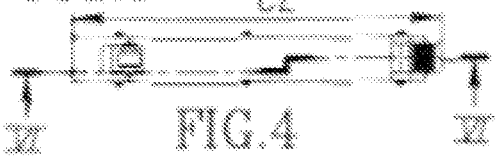
FIG. 4 is a top view of the clip of FIG. 2 in a closed position.
Figure 5:
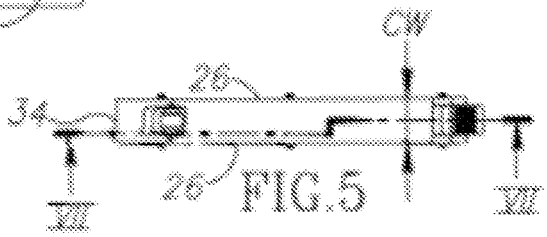
FIG. 5 is a top view of the clip of FIG. 2 in an open position.
Figure 9:
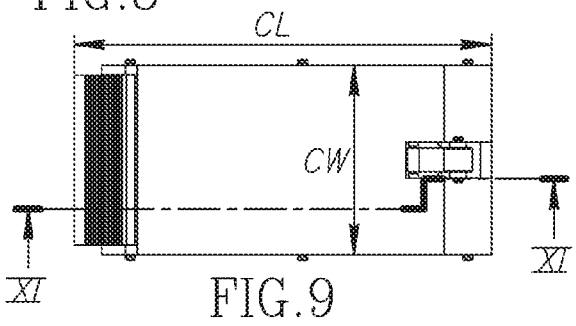
FIG. 9 is a top view of the clip of FIG. 8 in a closed position.
Figure 10:
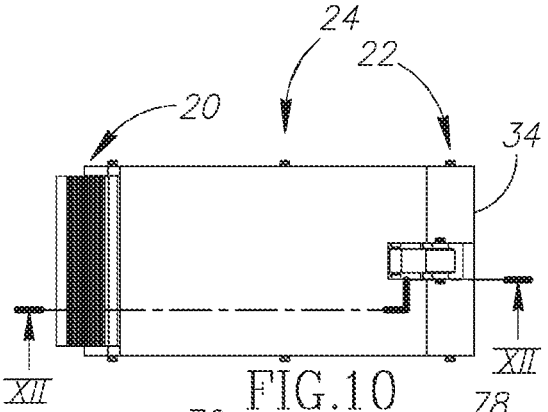
FIG. 10 is a top view of the clip of FIG. 8 in an open position.
Figure 11:
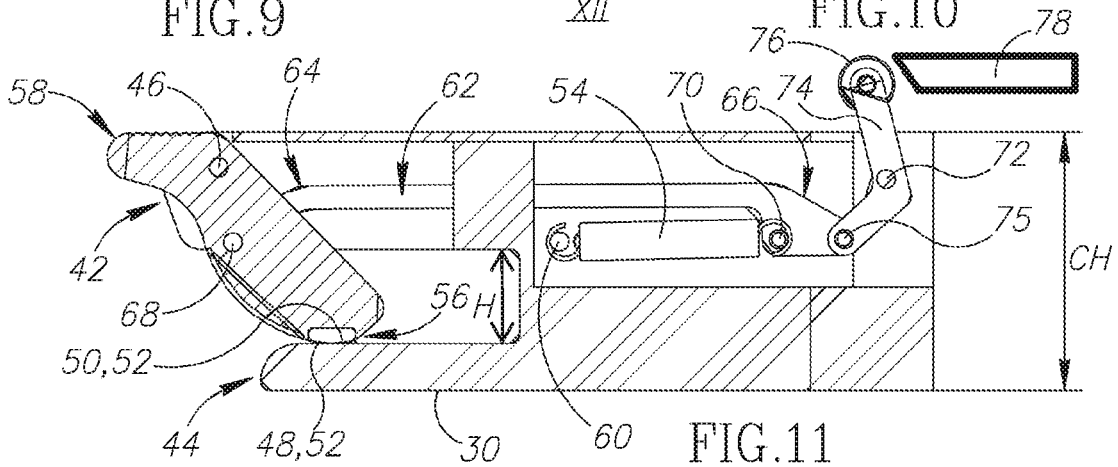
FIG. 11 is a cross-section of the clip of FIG. 9 taken along line XI-XI, before contacting a stopper.
Figure 12:
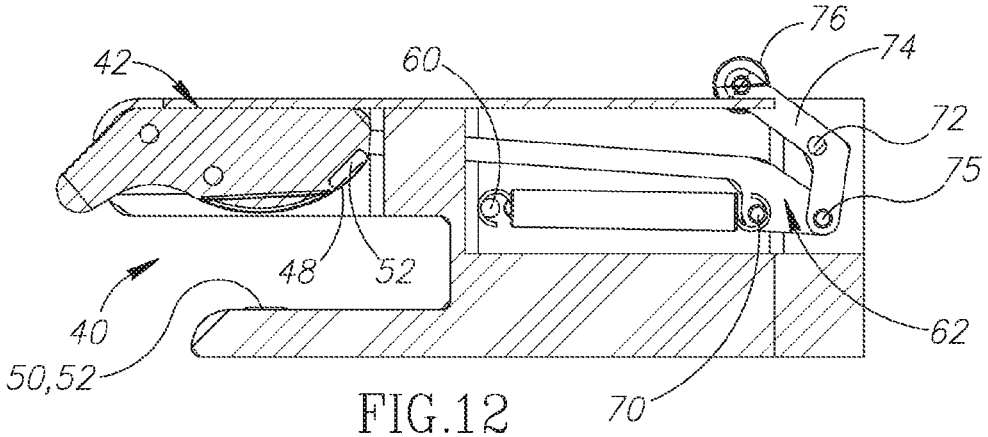
FIG. 12 is a cross-section of the clip of FIG. 10 taken along line XII-XII, after contacting the stopper, which transitioned the clip into the open position.
Figure 13:
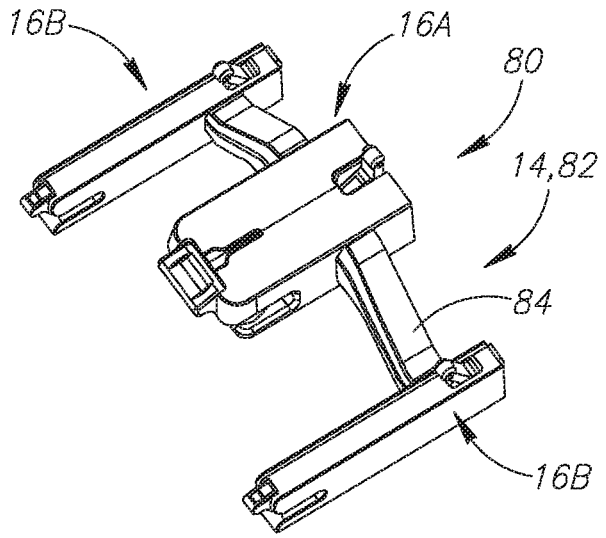
FIG. 13 is an isometric view of a clip assembly showing a preferred orientation of multiple clips arranged rigidly on a support structure.
Figure 14:
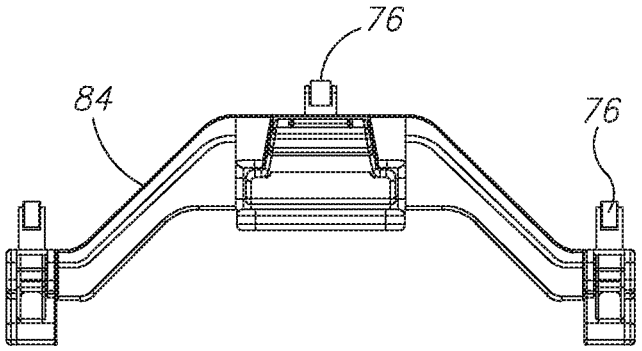
FIG. 14 is a front view of the clip assembly of FIG. 13.
Figure 15:
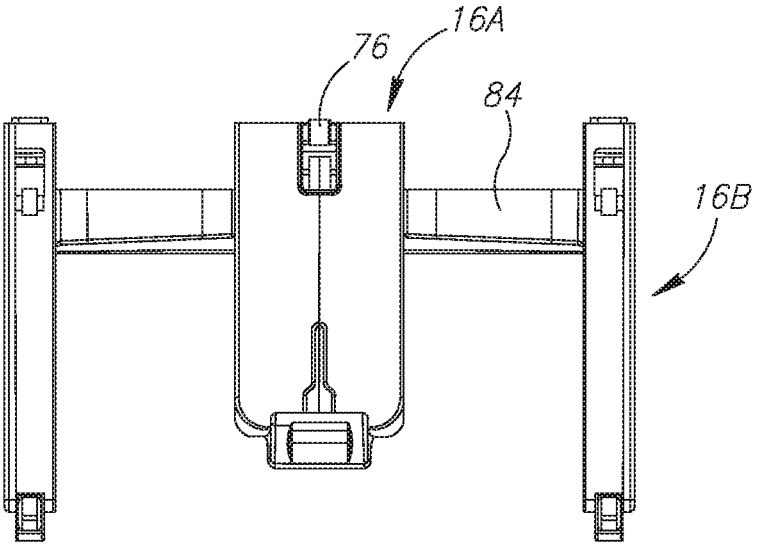
FIG. 15 is a top view of the clip assembly of FIG. 13.

Attention is drawn to FIGS. 13-15. According to the present embodiment, an article clip assembly 80 includes a major clip 16A and two minor clips 16B. Each clip 16 has a clip length CL measured in the depth axis Y parallel to the clip side surfaces 26 (see FIGS. 4 and 9). Each clip 16 has a clip height CH measured in the height axis Z in a view along the width axis X (see FIGS. 6 and 11). Each clip 16 has a clip width CW measured in the width axis X between the clip side surfaces 26 in a top view of the clip (FIGS. 5 and 9). Each minor clip 16B has a smaller clip width CW than clip width CW of the major clip 16A. The reasoning for this width difference lies in the different features and specifically dimensions that clothing articles have. For example, the major clip 16A is wider and therefore has a wider clamping recess 40 and clamping jaw 42. Specifically, the major clip 16A has a larger clamping recess height H than that of the minor clip 16B. The major clip 16A is therefore suited e.g., for trousers or generally long narrow items. A pair of minor clips 16B, on the other hand, are used for wide articles. Stated differently, the major clip 16A can handle narrower and/or thicker articles, while the minor clips 16B, in tandem, can handle wider articles than those handled by the major clip 16A.

After rigorous testing, it was found advantageous to rigidly combine, or assemble, two static minor clips 16B with a single, major clip 16A located therebetween. The rigid, tri-clip assembly design was able to handle efficiently a wide range of laundry article sizes and/or types within the desired width ranges. Wider items were fed to the two minor clips 16B and narrower items were fed only to the major clip 16A. The high efficiency is directly related, and attributed, to the assembly geometry, as will be further discussed below.

The major clip 16A can have a length to width, or major width, ratio CL/CW which can range between 1 and 4. According to the present embodiment the major width ratio CL/CW equals about 2.

The major clip 16A can have a length to height, or major height, ratio CL/CH which can range between 1.3 and 6. According to the present embodiment the major height ratio CL/CH equals about 2.8.

The minor clip 16B can have a minor width ratio CL/CW which can range between 3 and 20. According to the present embodiment the minor width ratio CL/CW equals about 7.7.

The minor clip 16B can have a minor height ratio CL/CH which can range between 2 and 10. According to the present embodiment the minor height ratio CL/CH equals about 4.1.

The above ratios are related to the fact that the clip length CL is preferably longer than the clip width CW and also longer than the clip height CH. This design was chosen such that in both the extended position (FIG. 1) and folded positions, in which the clip is entirely located within the folding machine (not shown), the clip 16 preferably has at least a portion thereof which is located inside, or within, the machine. Therefore, the rear lever 74, and specifically the friction-reduction member 76 are both always located inside the machine, i.e., preferably not visible to the user. This is advantageous also because it can prevent accidents such as fingers getting caught between the clip 16 and the folding machine 10.

The article clip assembly 80 is preferably a rigid structure. In other words, the minor clips 16B are rigidly secured to the major clip 16A via a support structure 82 which can include support arms 84. Each support arm 84 can extend between, and connect, two clips 16.

The support structure 82 can belong to, or referred to, as the hanger 14. According to the preferred embodiment, the hanger 14 can have a shape similar to triangle in a front view thereof, along the depth axis Y.

According to a preferred embodiment, the minor clips 16B extend at least partially further than the major clip 16A in the depth axis Y, in a side view along the width axis X. This, to allow clearance between the major and minor clips 16A, 16B which improves usability and handing over the article to the clips 16. Along the height axis Z, the major clip 16A is located at least partially above the minor clip 16B, for the same ergonomic reasons.

According to the subject matter of the present application, in an automatic-mode of the folding machine 10 sensors indicate when the operator is done, i.e., the fabric is appropriately clamped, and the hanger 14 automatically retracts while pulling the article into the folding machine 10. An example method of handing over an article to the folding machine 10 includes the following steps:

a. Holding the article at two article edges in a width direction (perpendicular to a longitudinal, or elongated direction of the article) of the article;
b. Inserting each article edge into the respective clamping recess 40, in between the clamping and base jaws 42, 44 of each clip 16; and
c. Releasing the article.

In a semi-automatic mode of the folding machine 10 another example method includes the following steps:

a. Holding the article at two article edges in the width direction of the article;
b. Inserting each article edge into the clamping recess 40 in between the clamping and base jaws 42, 44 of each clip 16;
c. Releasing the article; and
d. Pressing a button.

In a semi-automatic mode of the folding machine 10 another example method includes the following steps:

a. Holding the article at two article edges stretched in the width direction of the article;
b. Inserting both article edges simultaneously into the clamping recesses 40 in between the clamping and base jaws 42, 44 of both clips 16;
c. Releasing the article

The invention claimed is:

1. An article clip assembly (80) for laundry article folding machines (10) comprising:

a width axis (X), a depth axis (Y) and a height axis (Z) of a 3D euclidean space;

and one major clip (16A) extending along the depth axis (Y);

and two minor clips (16, 16B) extending along the depth axis (Y) and each of the two minor clips having a clip width (CW) shorter than a clip width (CW) of the major clip (16A); wherein each of the minor clips (16B) is rigidly secured to the major clip (16A) via a support structure (82) and spaced apart therefrom;

and wherein in a view along the depth axis (Y) the minor clips (16B) are located on opposite sides of the major clip (16A) in the width axis (X) direction.

2. The dip assembly (80) according to claim 1, wherein the minor and major clips (16, 16A, 16B) have different clamping recess heights (H) along the height axis (Z) direction, each clamping recess height (H) configured to accommodate different ranges of article sizes.

3. The clip assembly (80) according to claim 1, wherein the minor clips (16B) extend at least partially further than the major clip (16A) in the depth axis (Y) in a view along the width axis (X).

4. The article clip assembly (80) according to claim 1, wherein in a front view thereof, the major dip (16A) is located at least partially above the minor clip (16B) along the height axis (Z).

5. A folding machine (10) comprising a loading system (12) comprising the article clip assembly (80) according to claim 1.

* * * * *